US010249453B2

(12) United States Patent
Rogers et al.

(10) Patent No.: US 10,249,453 B2
(45) **Date of Patent: *Apr. 2, 2019**

(54) SWITCHES FOR USE IN MICROELECTROMECHANICAL AND OTHER SYSTEMS, AND PROCESSES FOR MAKING SAME

(71) Applicant: HARRIS CORPORATION, Melbourne, FL (US)

(72) Inventors: John E. Rogers, Gainsville, FL (US); Michael R. Weatherspoon, West Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 412 days.

This patent is subject to a terminal disclaimer.

(21) Appl. No.: 14/883,212

(22) Filed: Oct. 14, 2015

(65) Prior Publication Data

US 2016/0163477 A1 Jun. 9, 2016

Related U.S. Application Data

(60) Division of application No. 13/672,863, filed on Nov. 9, 2012, now Pat. No. 9,165,723, which is a (Continued)

(51) Int. Cl.
*H01H 11/00* (2006.01)
*H01H 11/06* (2006.01)
(Continued)

(52) U.S. Cl.
CPC ..... *H01H 11/06* (2013.01); *H01H 1/0036* (2013.01); *H01H 59/0009* (2013.01); (Continued)

(58) Field of Classification Search
CPC ..... H01H 57/00; H01H 1/00; H01H 1/20; H01H 1/023; H01H 3/00; H01H 3/02; (Continued)

(56) References Cited

U.S. PATENT DOCUMENTS 4,670,724 A 6/1987 Riblet et al.
5,025,264 A 6/1991 Stafford
(Continued)

FOREIGN PATENT DOCUMENTS

DE 102010034525 A1 2/2011
EP 0849820 A2 6/1998
(Continued)

OTHER PUBLICATIONS

Information about Related Patents and Patent Applications, see section 6 of the accompanying Information Disclosure Statement Letter, which concerns Related Patents and Patent Applications.
(Continued)

*Primary Examiner* — David P Turocy
*Assistant Examiner* — Mohammad Mayy
(74) *Attorney, Agent, or Firm* — Fox Rothschild LLP; Robert J. Sacco; Carol E. Thorstad-Forsyth

(57) ABSTRACT

Embodiments of switches (10) include first and second electrical conductors (34, 36) suspended within an electrically-conductive housing (28), and a contact element (16) having an electrically-conductive portion (53*b*) that establishes electrical contact between the first and second electrical conductors (34, 36) when the contact element (16) is in a closed position. The electrically-conductive portion (53*b*) is electrically isolated from a ground plane (27) of the switch (10) by adjacent electrically-insulative portions (53*a*, 53*c*) of the contact element (16).

10 Claims, 15 Drawing Sheets

Related U.S. Application Data continuation-in-part of application No. 13/592,435, filed on Aug. 23, 2012.

(51) Int. Cl.
*H01H 1/00* (2006.01)
*H01H 59/00* (2006.01)

(52) U.S. Cl.
CPC ..... *H01H 2001/0078* (2013.01); *H01H 2011/065* (2013.01)

(58) Field of Classification Search
CPC .... H01H 3/04; H01H 5/00; H01H 2001/0036; H01H 59/009; H01H 50/00
USPC ..... 200/181, 239, 238, 600; 335/78; 333/236, 239, 243, 244, 245, 248
See application file for complete search history.

(56) References Cited

U.S. PATENT DOCUMENTS

| | | | |
|---|---|---|---|
| 6,384,353 | B1 | 5/2002 | Huang et al. |
| 6,587,021 | B1 | 7/2003 | Streeter |
| 6,600,395 | B1 | 7/2003 | Handforth et al. |
| 6,812,718 | B1 | 11/2004 | Chong et al. |
| 6,822,532 | B2 | 11/2004 | Kane et al. |
| 6,876,333 | B2 | 4/2005 | Tasi |
| 6,903,687 | B1 | 6/2005 | Fink et al. |
| 7,012,489 | B2 | 3/2006 | Sherrer et al. |
| 7,026,899 | B2 | 4/2006 | Adams et al. |
| 7,123,119 | B2 | 10/2006 | Pashby et al. |
| 7,126,447 | B2 | 10/2006 | Kawai |
| 7,259,640 | B2 | 8/2007 | Brown et al. |
| 7,381,583 | B1 | 6/2008 | Ebel et al. |
| 7,449,784 | B2 | 11/2008 | Sherrer et al. |
| 7,898,356 | B2 | 3/2011 | Sherrer et al. |
| 8,354,902 | B2 | 1/2013 | Kawabata et al. |
| 8,921,997 | B2 | 12/2014 | Shimooka et al. |
| 2004/0066338 | A1 | 4/2004 | Chen et al. |
| 2004/0069608 | A1 | 4/2004 | Shimizu et al. |
| 2004/0166603 | A1 | 8/2004 | Carley |
| 2004/0189530 | A1 | 9/2004 | Chung et al. |
| 2005/0001701 | A1 | 1/2005 | Shirakawa |
| 2005/0067292 | A1 | 3/2005 | Thompson et al. |
| 2005/0073380 | A1 | 4/2005 | Howell et al. |
| 2005/0116788 | A1 | 6/2005 | Matters-Kammerer et al. |
| 2005/0146022 | A1 | 7/2005 | Franosch et al. |
| 2005/0161753 | A1 | 7/2005 | Huff et al. |
| 2005/0190019 | A1 | 9/2005 | Metz |
| 2007/0018761 | A1 | 1/2007 | Yamanaka et al. |
| 2008/0142347 | A1 | 6/2008 | Lewis et al. |
| 2008/0164542 | A1 | 7/2008 | Yang et al. |
| 2008/0191817 | A1* | 8/2008 | Sherrer ..... H01P 3/06 333/244 |
| 2008/0240656 | A1* | 10/2008 | Rollin ..... H01P 3/06 385/50 |
| 2008/0246562 | A1* | 10/2008 | Sherrer ..... H01P 3/06 333/260 |
| 2009/0260961 | A1 | 10/2009 | Luce et al. |
| 2010/0277259 | A1 | 11/2010 | Ahn et al. |
| 2011/0220472 | A1* | 9/2011 | Masuda ..... H01H 59/0009 200/181 |
| 2012/0175715 | A1 | 7/2012 | Hammond et al. |
| 2013/0140165 | A1 | 6/2013 | Lin et al. |

FOREIGN PATENT DOCUMENTS

| | | | |
|---|---|---|---|
| EP | 1515390 | A1 | 3/2005 |
| EP | 1713144 | A1 | 10/2006 |
| EP | 1939974 | A1 | 7/2008 |
| EP | 2546920 | A1 | 1/2013 |
| ES | 2191642 | | 9/2003 |
| WO | 2003/049514 | A2 | 6/2003 |
| WO | 2004/079795 | A2 | 9/2004 |
| WO | 2011/111274 | A1 | 9/2011 |

OTHER PUBLICATIONS

International Search Report and Written Opinion dated Dec. 20, 2013 issued in International Appln. No. PCT/US2013/056368 (12 pages).

Lau, N.U.and Sloan, R., Suspended Microstrip Patch Antenna With Ground-shield Tapered Suspended Stripline Feed, 33rd European Microwave Conference, Munich 2003, 1385-1387.

International Search Report and Written Opinion dated Jan. 16, 2014 issued in International Appln. No. PCT/US2013/06443 (12 pages).

International Search Report and Written Opinion dated Nov. 28, 2013 for Interational Patent Appln. No. PCT/US2013/056316 to Harris Corporation (11 pages).

International Search Report and Written Opinion dated Jan. 31, 2014 in International Patent Appln. No. PCT/US2013/065405 to Harris Corporation (9 pages).

International Preliminary Report on Patentability dated Mar. 24, 2015 issued in International Appln. No. PCT/US2013/060814 (7 pages).

International Preliminary Report on Patentability dated Mar. 24, 2015 issued in International Appln. No. PCT/US2013/060817 (8 pages).

International Preliminary Report on Patentability dated Apr. 30, 2015 issued in International Appln. No. PCT/US2013/065405 (6 pages).

* cited by examiner

SWITCHES FOR USE IN MICROELECTROMECHANICAL AND OTHER SYSTEMS, AND PROCESSES FOR MAKING SAME

CROSS REFERENCE TO RELATED APPLICATION

This application is a divisional application and claims priority to non-provisional application Ser. No. 13/672,863, filed on Nov. 9, 2012 which is a continuation-in-part of and claims priority to co-pending non-provisional application Ser. No. 13/592,435, filed on Aug. 23, 2012 and currently abandoned, and is hereby incorporated by reference in their entirety.

BACKGROUND OF THE INVENTION

Statement of the Technical Field

The inventive arrangements relate to switches, such as broad-band, low-loss radio frequency (RF) microelectromechanical systems (MEMS) switches.

Description of Related Art

Communications systems, such as broadband satellite communications systems, commonly operate at anywhere from 300 MHz (UHF band) to 300 GHz (mm-wave band). Such examples include TV broadcasting (UHF band), land mobile (UHF band), global positioning systems (GPS) (UHF band), meteorological (C band), and satellite TV (SHF band). Most of these bands are open to mobile and fixed satellite communications. Higher frequency bands typically come with larger bandwidths, which yield higher data rate operation. Switching devices used in these types of systems need to operate with relatively low losses, e.g., less than one decibel (dB) of insertion loss, at these ultra-high frequencies.

Miniaturized switches such as monolithic microwave integrated circuit (MMIC) and MEMS switches are commonly used in broadband communications systems due to stringent constraints imposed on the components of such systems, particularly in satellite-based applications. Currently, the best in class switches operate at 40 GHz with culumative attributes such as insertion losses of approximately 0.6 dB, return losses of approximately 13 dB, and isolation levels of approximately 40 dB.

Three-dimensional microstructures can be formed by utilizing sequential build processes. For example, U.S. Pat. Nos. 7,012,489 and 7,898,356 describe methods for fabricating coaxial waveguide microstructures. These processes provide an alternative to traditional thin film technology, but also present new design challenges pertaining to their effective utilization for advantageous implementation of various devices such as miniaturized switches.

SUMMARY OF THE INVENTION

Embodiments of switches include a ground housing; a first electrical conductor, and a second electrical conductor spaced apart from the first electrical conductor. The first and second electrical conductors are suspended within the ground housing on electrically-insulative supports. The switches further include a contact element having an electrically-insulative first portion, an electrically-conductive second portion, and an electrically-insulative third portion. The first and third portions of the contact element adjoin the second portion. The contact element is configured for movement between a first position at which the second portion of the contact element is spaced apart and electrically isolated from the first and second electrical conductors, and a second position at which the second portion of the contact element contacts the first and second electrical conductors.

Other embodiments of switches include a ground plane, and a housing electrically connected to the ground plane and having one or more inner surfaces that define a channel. The switches also include a first and a second electrical conductor suspended within the channel, spaced apart from the one or more inner surfaces of the housing by a first air gap, and spaced apart from each other by a second air gap. The switches further include a contact element mounted on the ground plane and being operative to move between a first position at which an electrically-conductive portion of the contact element is spaced part and electrically isolated from the first and second electrical conductors by respective third and forth air gaps, and a second position at which the electrically-conductive portion of the contact element contacts the first and second electrical conductors and bridges the second air gap to establish electric contact between the first and second electrical conductors. The contact element further includes a first electrically insulative portion configured to electrically isolate the electrically-conductive portion of the contact element from the ground plane.

In accordance with further aspects of the inventive concepts claimed herein, processes for making switches include selectively depositing a first layer of an electrically-conductive material on a substrate to form at least a portion of a ground plane and an actuator. The processes further include selectively depositing a second layer of the electrically-conductive material on the first layer and the substrate to form or further form the actuator, a portion of a housing, and a portion of a mount for a contact element configured to electrically connect a first and a second electrical conductor on a selective basis when actuated by the actuator. The processes also include selectively depositing a portion of a third layer of the electrically-conductive material on the first and second layers and the substrate to form or further form the housing, the actuator, the mount, the contact element, and the first and second electrical conductors.

BRIEF DESCRIPTION OF THE DRAWINGS

Embodiments will be described with reference to the following drawing figures, in which like numerals represent like items throughout the figures and in which.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

The figures depict a MEMS switch 10. The switch 10 can selectively establish and disestablish electrical contact between a first and second electronic component (not shown) electrically connected thereto. The switch 10 has a maximum height ("z" dimension) of approximately 1 mm; a maximum width ("y" dimension) of approximately 3 mm; and a maximum length ("x" dimension) of approximately 3 mm. The switch 10 is described as a MEMS switch having these particular dimensions for exemplary purposes only. Alternative embodiments of the switch 10 can be scaled up or down in accordance with the requirements of a particular application, including size, weight, and power (SWaP) requirements.

Figure 1:
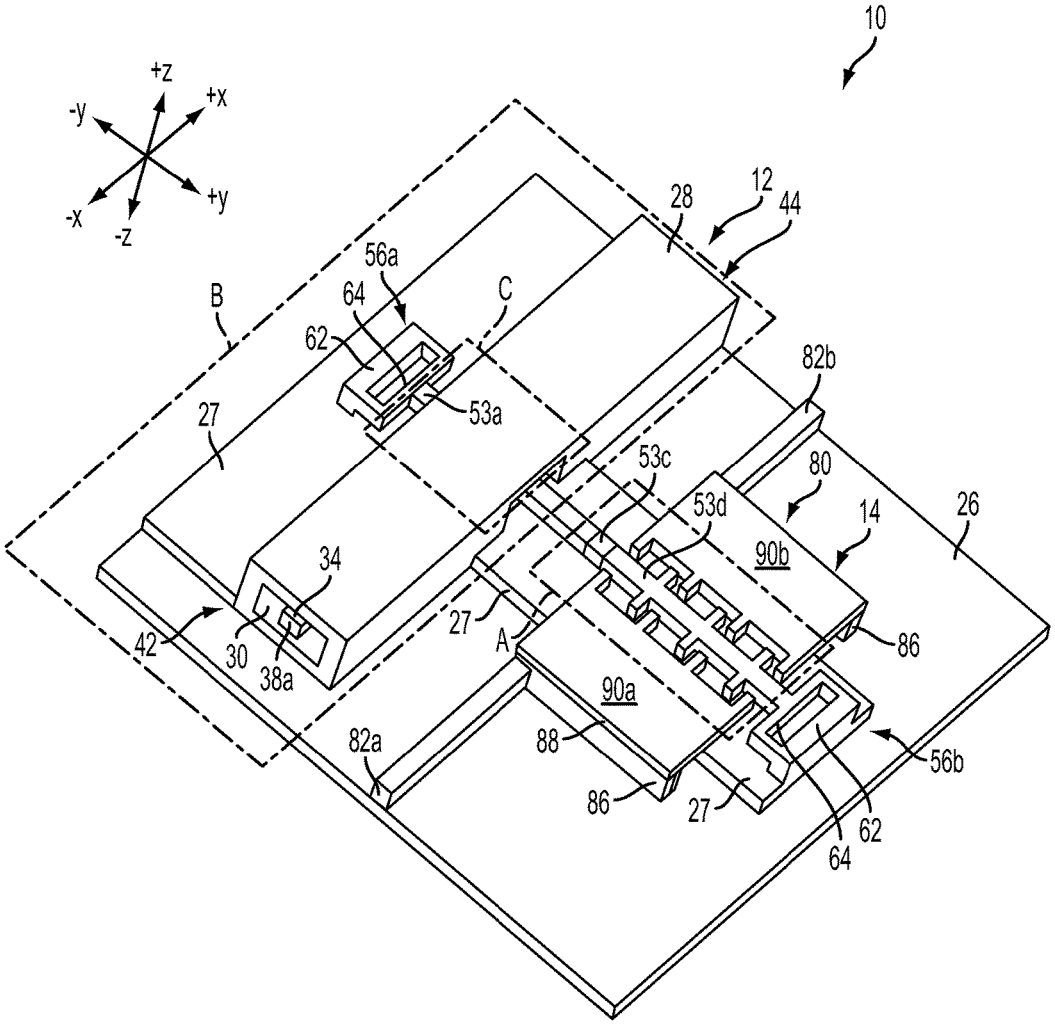
FIG. 1 is a top perspective view of a MEMS switch, depicting a shuttle of the switch in an open position.
Figure 2:
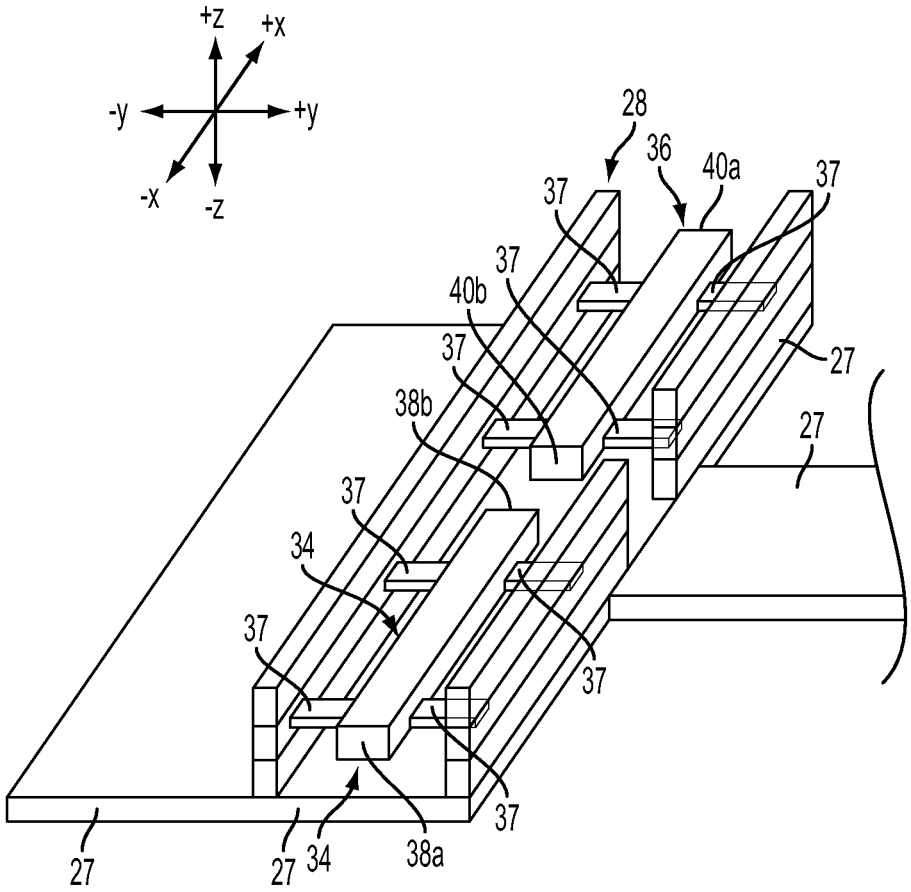
FIG. 2 is a top perspective view of a ground housing, and a portion of a ground plane the switch shown in FIG. 1, with a top layer of the housing removed for clarity of illustration.

The switch 10 comprises a contact portion 12, an actuator portion 14, and a contact element in the form of a shuttle 16, as shown in FIG. 1. The first and second electronic components are electrically connected to opposite ends of the contact portion 12, and are electrically connected to each other on a selective basis via the contact portion 12. As discussed below, the shuttle 16 moves in the "y" direction between an open and a closed position, in response to energization and de-energization of the actuator portion 14. The shuttle 16 facilitates the flow of electric current through the contact portion 12 when the shuttle 16 is in its closed position, thereby establishing electrical contact between the first and second electronic components. Current does not flow through the contact portion 12 when the shuttle 16 is in its open position. Thus, the first and second electronic components are electrically isolated from each other when the shuttle 16 is in its open position.

Figure 4:
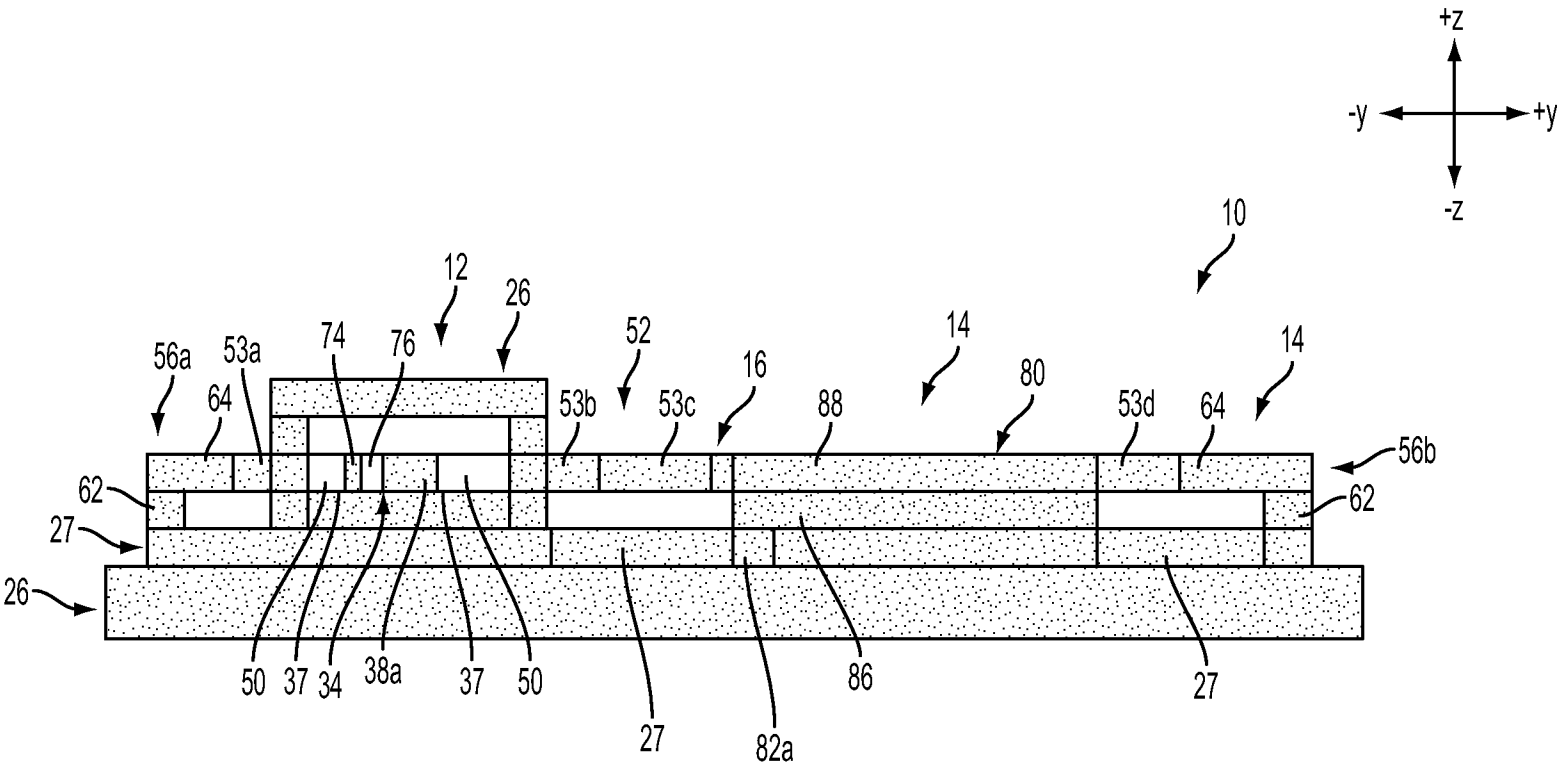
FIG. 4 front view of the switch shown FIGS. 1-3, depicting the shuttle in the open position and showing the layered structure of the switch, and with relief added to better denote the illustrated structure.

The switch 10 comprises a substrate 26 formed from a dielectric material such as silicon (Si), as shown in FIGS. 1 and 4. The substrate 26 can be formed from other materials, such as glass, silicon-germanium (SiGe), or gallium arsenide (GaAs) in alternative embodiments. The switch 10 also includes a ground plane 27 disposed on the substrate 26. The switch 10 is formed from five layers of an electrically-conductive material such as copper (Cu). Each layer can have a thickness of, for example, approximately 50 μm. The ground plane 27 is part of a first or lowermost layer of the electrically-conductive material. The number of layers of the electrically-conductive material is applicant-dependent, and can vary with factors such as the complexity of the design, hybrid or monolithic integration of other devices with the switch 10, the overall height ("z" dimension) of the switch 10, the thickness of each layer, etc.

The contact portion 12 of the switch 10 includes an electrically-conductive ground housing 28 disposed on the ground plane 27, as illustrated in FIGS. 1 and 4. The ground housing 28 is formed from portions of the second through fifth layers of the electrically-conductive material. The ground housing 28 and the underlying portion of the ground plane 27 define an internal channel 30 that extends substantially in the "x" direction, as depicted in FIGS. 1-4, 6A, and 6B.

The contact portion 12 further includes an electrically-conductive first inner conductor 34 and an electrically-conductive second inner conductor 36 each having a substantially rectangular cross section, as shown in FIGS. 1-4, 6A, and 6B. The first and second inner conductors 34, 36 can each be formed as part of the third layer of the electrically-conductive material.

The first and second inner conductors 34, 36 are positioned within the channel 30, as shown in FIGS. 1-4, 6A, and 6B. A first end 38*a* of the first inner conductor 34 is positioned at a first end of the channel 30. A first end 40*a* of the second inner conductor 36 is positioned at a second end of the channel 30. A second end 38*b* of the first inner conductor 34 is spaced apart from a second end 40*b* of the second inner conductor 36 by an air gap 44, and as discussed below, by a portion of the shuttle 16 positioned within the air gap 44.

The first inner conductor 34 and the surrounding portion of the ground housing 28 define an input port 42 of the contact portion 12. The second inner conductor 36 and the surrounding portion of the ground housing 28 define an output port 44 of the contact portion 12. The first electronic device can be electrically connected to the input port 42. The second electronic device can be electrically connected to the output port 44. The first and second electronic devices can be integrated with the respective input and output ports 42, 44 by, for example, hybrid integration methods such as wire-bonding and flip-chip bonding.

The first and second inner conductors 34, 36 are each suspended within the channel 34 on electrically-insulative tabs 37, as illustrated in FIGS. 2, 3, 6A and 6B. The tabs 37 are formed from a dielectric material. For example, the tabs 37 can be formed from polyethylene, polyester, polycarbonate, cellulose acetate, polypropylene, polyvinyl chloride, polyvinylidene chloride, polystyrene, polyamide, polyimide, benzocyclobutene, SU8, etc., provided the material will not be attacked by the solvent used to dissolve the sacrificial resist during manufacture of the switch 10 as discussed below. The tabs 37 can each have a thickness of, for example, approximately 15 μm. Each tab 37 spans the width, i.e., y-direction dimension, of the channel 30. The ends of each tab 37 are sandwiched between the portions of the second and third layers of electrically-conductive material that form the sides of the ground housing 28. The first and second inner conductors 34, 36 are surrounded by, and are spaced apart from the interior surfaces of the ground housing 28 by an air gap 50. The air gap 50 acts as a dielectric that electrically isolates the first and second inner conductors 34, 36 from the ground housing 28. The type of transmission-line configuration is commonly referred to as a "recta-coax" configuration, otherwise known as micro-coax.

The shuttle 16 has an elongated body 52 that extends substantially in the "y" direction, as shown in FIGS. 1-6B. The body 52 includes an electrically-insulative first portion 53*a*, and an adjoining, electrically-conductive second portion 53*b*. The body 52 also includes an electrically-insulative third portion 53*c* that adjoins the second portion 53*b*, and an electrically-conductive fourth portion 53*d* that adjoins the third portion 53*c*. The electrically-conductive second and fourth portions 53*b*, 53*d* of the body 52 are formed as part of the third layer of the electrically-conductive material. The electrically-insulative first and third portions 53*a*, 53*c* are formed from a dielectric material such as polyethylene, polyester, polycarbonate, cellulose acetate, polypropylene, polyvinyl chloride, polyvinylidene chloride, polystyrene, polyamide, polyimide, benzocyclobutene, SU8, etc., provided the material will not be attacked by the solvent used to dissolve the sacrificial resist during manufacture of the switch 10 as discussed below.

Figure 5A:
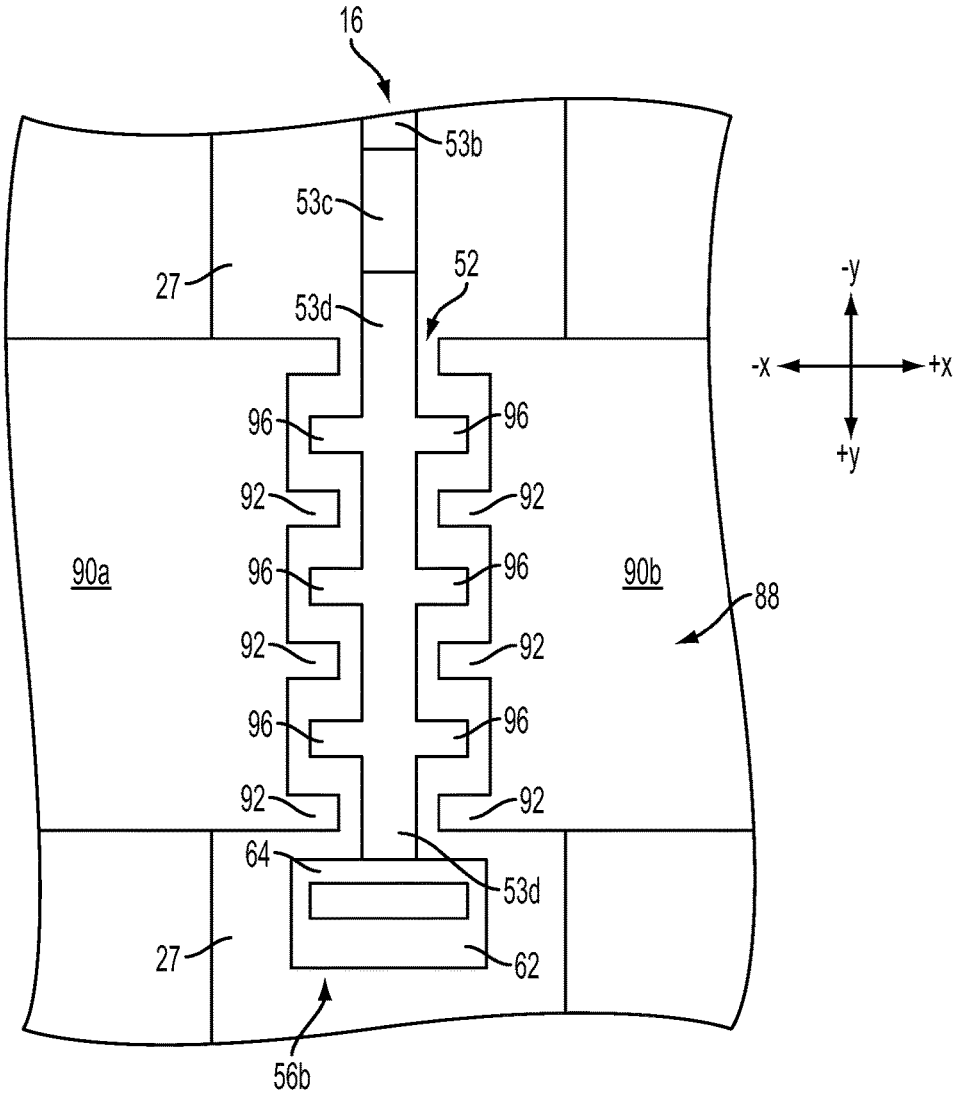
FIG. 5A is a top, magnified view of the area designated "A" in FIG. 1, depicting the shuttle in the open position.
Figure 5B:
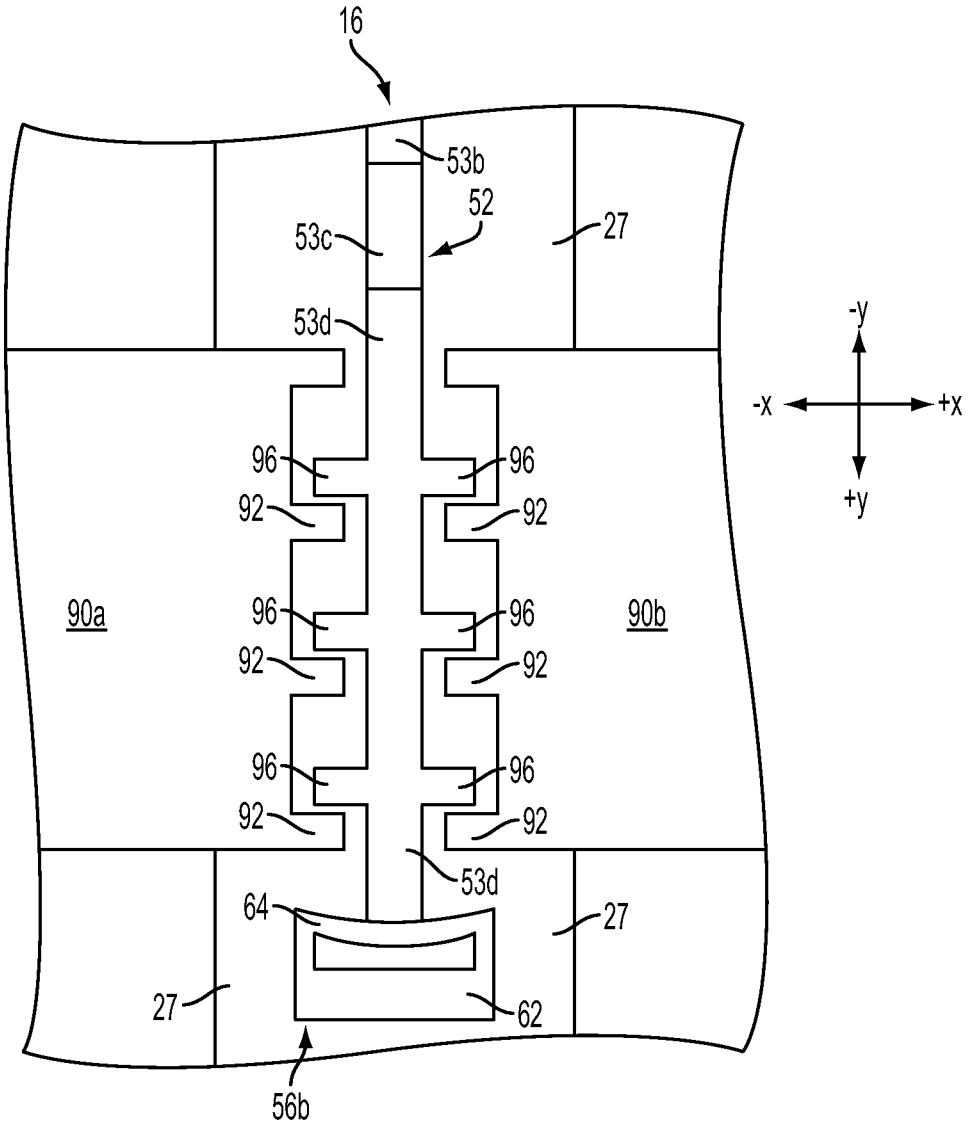
FIG. 5B is a top, magnified view of the area designated "A" in FIG. 1, depicting the shuttle in a closed position.
Figure 6A:
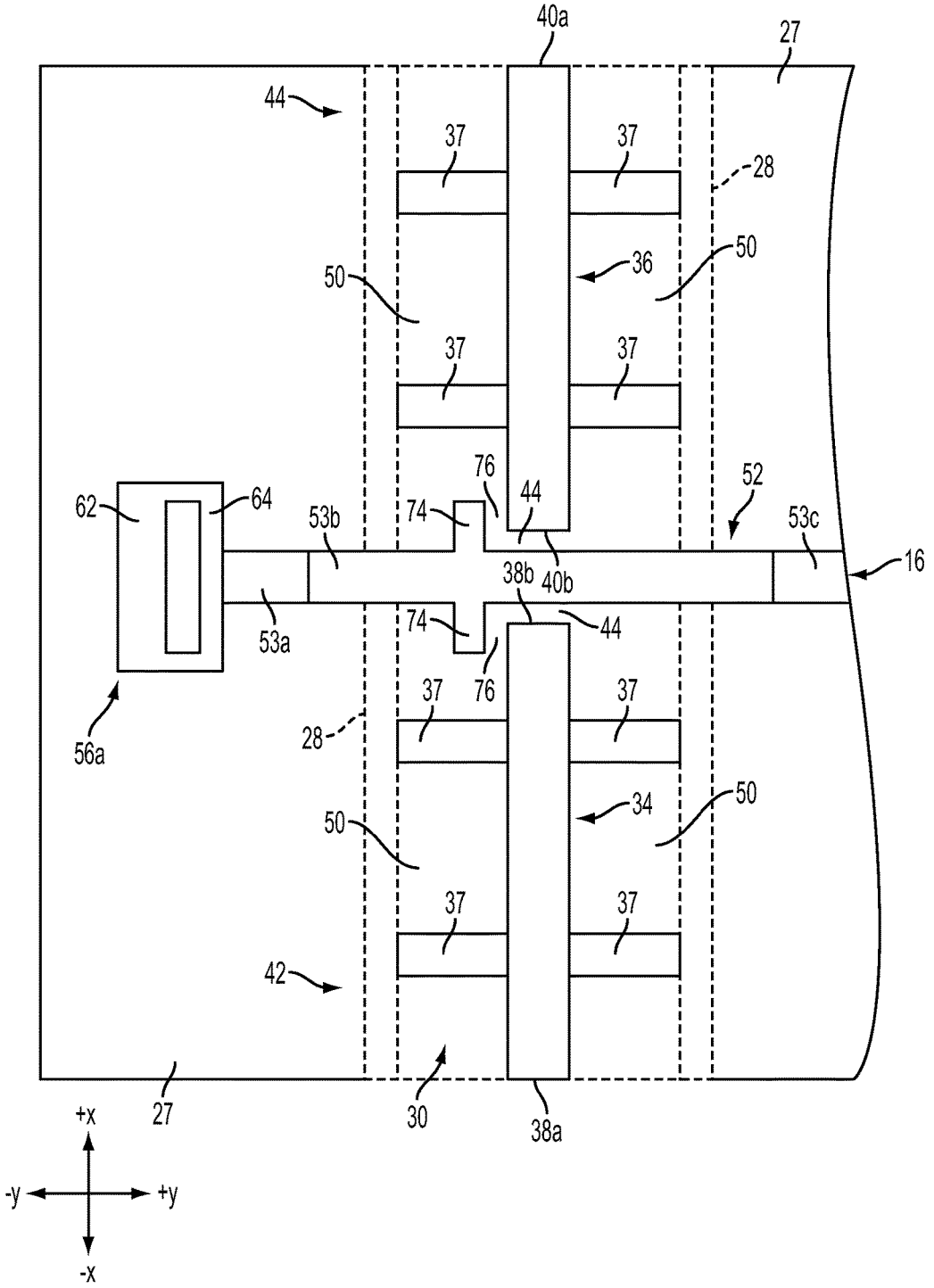
FIG. 6A is a top view of the area designated "B" in FIG. 1, depicting a ground housing of the switch in phantom, and depicting the shuttle in the open position.
Figure 6B:
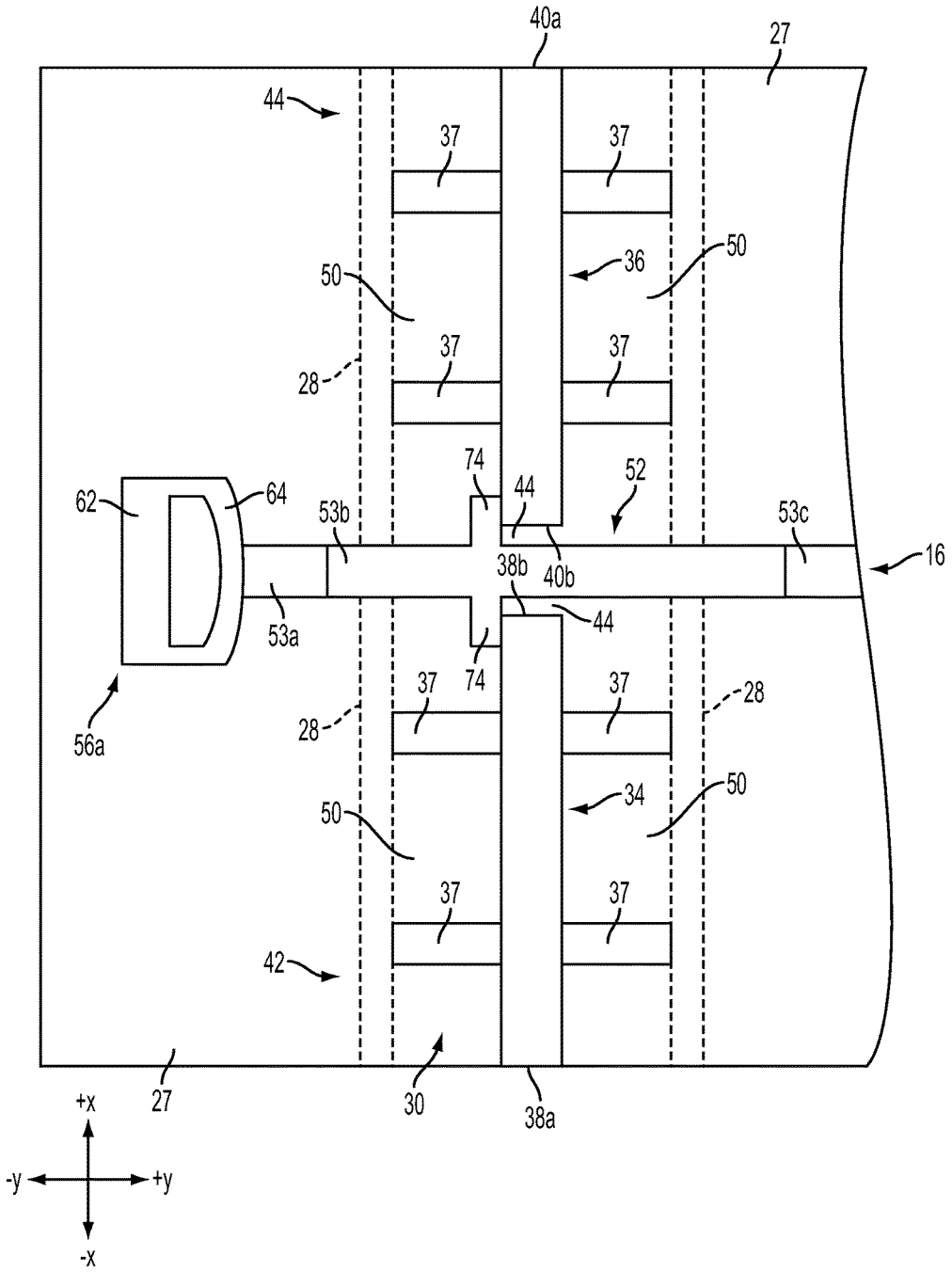
FIG. 6B is a top view of the area designated "B" in FIG. 1, depicting a ground housing of the switch in phantom, and depicting the shuttle in the closed position.

The switch 10 includes a first mount 56*a* and a substantially identical second mount 56*b*. The first mount 56*a* is disposed on the portion of the ground plane 27 associated with the contact portion 12 of the switch 10, as shown in FIGS. 1, 6A, and 6B. The second mount 56*b* is disposed on the portion of the ground plane 27 associated with the actuator portion 14 of the switch 10, as illustrated in FIGS. 1, 5A, and 5B.

The first and second mounts 56*a*, 56*b* each include a base 62 that adjoins the ground plane 27, and a beam portion 64 that adjoins the base 62. Each base 62 is formed as part of the second and third layers of the electrically-conductive material. The beam portions 64 are formed as part of the third layer of the electrically-conductive material. It should be noted that the configuration of the beam portions 64 is application-dependent, and can vary with factors such as the amount of space available to accommodate the beam portions 64, the required or desired spring constant of the beam portions 64, etc. Accordingly, the configuration of the beam portions 64 is not limited to that depicted in FIG. 1.

An end of the first portion 53*a* of the shuttle 16 adjoins the beam portion 64 of the first mount 56*a*, as depicted in FIGS. 1, 6A, and 6B. An end of the fourth portion 53*d* of the shuttle 16 adjoins the beam portion 64 of the second mount 56*b*, as illustrated in FIGS. 1, 5A, and 5B. The shuttle 16 is thus suspended from, and fully supported by the first and second mounts 56*a*, 56*b* by virtue of the mechanical connection between the first portion 53*a* of the shuttle 16 and the beam portion 64 of the first mount 56*a*; and the mechanical connection between the fourth portion 53*d* of the shuttle 16 and the beam portion 64 of the second mount 56*b*.

The beam portions 64 are configured to deflect so as to facilitate movement of the shuttle 16 in its lengthwise direction, i.e., in the "y" direction. In particular, the shuttle 16 is in its open position when the beam portions 64 are in their neutral, or un-deflected positions, as depicted in FIGS. 1, 3, 5A, and 6A. The beam portions 64 deflect when the shuttle 16 is urged in the "+y" direction, toward its closed position, due to electrostatic forces developed in the actuator portion 14 as discussed below. The beam portions 64 are shown in their deflected state in FIGS. 5B and 6B.

Figure 3:
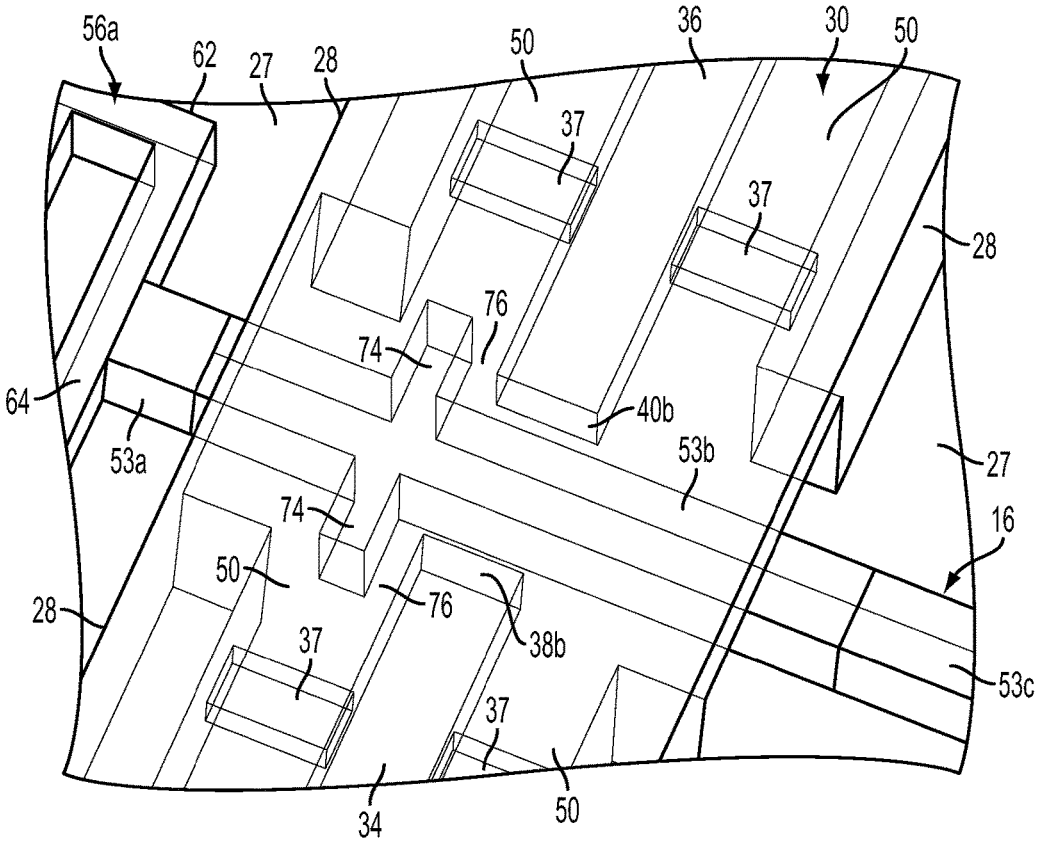
FIG. 3 is a magnified view of the area designated "C" in FIG. 1, depicting the housing and shuttle as transparent.

The second portion 53*b* of the shuttle 16 includes two projections in the form of fingers 74, as shown in FIGS. 3, 6A and 6B. The fingers 74 are located on opposite sides of the second portion 53*b*, and extend substantially perpendicular to the lengthwise direction of the body 52, i.e., in the "+/−x" directions. The shuttle 16 is configured so that one of the fingers 74 faces, and is spaced apart from the first inner conductor 34 by an air gap 76 when the shuttle 16 is in its open position. The other finger 74 faces, and is spaced apart from the second inner conductor 36 by another air gap 76 when the shuttle 16 is in its open position. The air within the air gaps 76 acts as a dielectric insulator that electrically isolates the fingers 74 from the first and second inner conductors 34, 36 when the shuttle 16 is in its open position.

Movement of the shuttle 16 to its closed position causes each of the fingers 74 to traverse and close the associated air gap 76 as the finger 74 moves into contact with its associated first or second inner conductor 34, 36 as shown in FIG. 6B. The electrically-conductive fingers 74 and the adjoining second portion 53*b* of the body 52 thus bridge the air gaps 76 when the fingers 74 are in contact with the first and second inner conductors 34, 36, thereby establishing electrical contact between the first and second inner conductors 34, 36.

The air gaps 44, 76 act as a dielectric insulator that electrically isolates the first inner conductor 34 from the second inner conductor 38 when the shuttle 16 is in its open position. As shown in FIG. 6A, although the second portion 53*b* of the shuttle 16 extends though the air gap 44 between the second ends 38*b*, 40*b* of the first and second inner conductors 34, 36, the second portion 53*b* does not contact either of the second ends 38*b*, 40*b*. Thus, current is not transmitted between the first and second inner conductors 34, 36 via the second portion 53*b* when the shuttle 16 is in its open position.

By bridging the air gaps 76 when the shuttle 16 is in the closed position, as shown in FIG. 6B, the shuttle 16 electrically connects the first and second inner conductors 34, 36, thereby closing the switch 10 so that electric current can flow there through via a signal path formed by the first and second inner conductors 34, 36 and the second portion 53*b* of the shuttle 16.

The second portion 53*b* of the body 52 adjoins the electrically-insulative first and third portions 53*a*, 53*c* of the body 52, as depicted in FIGS. 1 and 3-6B. The first portion 53*a* electrically isolates the second portion 53*b* from the electrically-conductive first mount 56*a*. The third portion 53*c* electrically isolates the second portion 53*b* from the electrically-conductive fourth portion 53*d*. Thus, electrical isolation of the signal path through the switch 10 is achieved by way of the air gaps 50 between the first and second inner conductors 34, 36 and the adjacent internal surfaces of the ground housing 28; and by way of the first and third portions 53*a*, 53*c* of the shuttle 16.

The actuator portion 14 of the switch 10 includes a body 80, a first lead 82*a*, and a second lead 82*b*, as shown in FIGS. 1 and 4. The body 80 includes two legs 86, and an adjoining top portion 88. The legs 86 are formed as part of the first and second layers of the electrically-conductive material. The top portion 88 is formed as part of the third layer of the electrically-conductive material. The legs 86 are disposed on the substrate 26, on opposite sides of the ground plane 27 as shown in FIG. 1. The body 80 thus straddles the ground plane 27, and is not in mechanical or electrical contact with the ground plane 27.

The top portion 88 of the body 80 includes a first half 90*a* and a second half 90*b*, as depicted in FIGS. 1, 5A, and 5B. The first half 90*a* is associated with one of the legs 86, and the second half 90*b* is associated with the other leg 86 as shown in FIG. 1. The first and second halves 90*a*, 90*b* are positioned on opposite sides of the fourth portion 53*d* of the shuttle 16. The first and second halves 90*a*, 90*b* each include three projections in the form of fingers 92 that extend substantially in the "x" direction. The optimal number of fingers 92 is application-dependent, and can vary with factors such as the amount of force that is needed to move the shuttle 16 to its closed position.

The fourth portion 53*d* of the body 52 of the shuttle 16 includes six projections in the form of fingers 96 that extend substantially in the "x" direction as illustrated in FIGS. 1, 5A, and 5B. Three of the fingers 96 are disposed on a first side of the fourth portion 53*d*, and the other three fingers 96 are disposed on the other side of the fourth portion 53*d*. The fourth portion 53*d* and the first and second halves 90*a*, 90*b* of the body 80 are configured so that the fingers 92 and the fingers 96 are interleaved or interdigitated, i.e., the fingers 92, 96 are arranged in an alternating fashion along the "y" direction. Moreover, each of the fingers 96 is positioned proximate and associated one of the fingers 92 as depicted in FIG. 5A, and is separated from the associated finger 92 by a gap of, for example, approximately 50 μm when the shuttle 16 is in its open position.

The first and second leads 82*a*, 82*b* of the actuating portion 14 are disposed on the substrate 26 as shown in FIG. 1, and are formed as part of the first layer of the electrically conductive material. The first lead 82*a* adjoins the leg 86 associated with the first half 90*a* of the top portion 88 of the body 80. The second lead 82*b* adjoins the leg 86 associated with the second half 90*b* of the top portion 88. The first and second leads 82*a*, 82*b* can be electrically connected to a voltage source, such as a 120-volt direct current (DC) voltage source (not shown). Because the first and second halves 90*a*, 90*b* of the top portion 88 are in contact with their associated legs 86, energization of the first and second leads 82*a*, 82*b* results in energization of the first and second halves 90*a*, 90*b*, including the fingers 92.

Subjecting the first and second leads 82*a*, 82*b* to a voltage causes the shuttle 16 to move from its open to its closed position, and to remain in the closed position, due to the resulting electrostatic attraction between the shuttle 16 and the actuator portion 14, as follows. As discussed above, the first portion 53*a* of the shuttle 16 adjoins the beam portion 64 of the first mount 56*a*, and the fourth portion 53*d* of the shuttle 16 adjoins the beam portion 64 of the second mount 56*b*, so that the shuttle 16 is suspended from the first and second mounts 56*a*, 56*b*. The beam portions 64 are in their neutral or un-deflected positions when the shuttle 16 is in its open position, as depicted in FIGS. 5A and 6A. Moreover, the fourth portion 53*d* of the shuttle 16 is electrically connected to the ground plane 26 by way of the second mount 56*b*, and is electrically isolated from the second portion 53*b* of the shuttle 16 by the third portion 53*c* of the shuttle 16. The fourth portion 53*d*, including the fingers 96 thereof, thus remains in a grounded, or zero-potential state at all times.

Subjecting the first and second leads 82*a*, 82*b* of the actuator portion 14 to a voltage potential results in energization of the fingers 92, as discussed above. The energized fingers 92 act as electrodes, i.e., an electric field is formed around each finger 92 due the voltage potential to which the finger 92 is being subjected. Each of the energized fingers 92 is positioned sufficiently close to its associated finger 96 on the grounded shuttle 16 so as to subject the associated finger 96 to the electrostatic force resulting from the electric field around the finger 92. The electrostatic force attracts the finger 96 to its corresponding finger 92.

The net electrostatic force acting on the six fingers 96 urges the shuttle 16 in the "+y" direction. The beam portions 64 of the first and second mounts 56*a*, 56*b*, which were in their neutral or un-deflected state prior to energization of the fingers 92, are configured to deflect in response to this force as shown in FIGS. 5B and 6B, thereby permitting the suspended shuttle 16 to move in the "+y" direction to its closed position.

The relationship between the amount of deflection and the voltage applied to the actuator portion 14 is dependent upon the stiffness of the beam portions 64, which in turn is dependent upon factors that include the shape, length, and thickness of the beam portions 64, and the properties, e.g., Young's modulus, of the material from which the beam portion 64 are formed. These factors can be tailored to a particular application so as to minimize the required actuation voltage, while providing the beam portion 64 with sufficient strength for the particular application; with sufficient stiffness to tolerate the anticipated levels shock and vibration; and with sufficient resilience to facilitate the return of the shuttle 16 to its open position when the voltage potential to the actuator portion 14 is removed.

The actuator portion 14 can have a configuration other than that described above in alternative embodiments. For example, suitable comb, plate, or other types of electrostatic actuators can be used in the alternative. Moreover, actuators other than electrostatic actuators, such as thermal, magnetic, and piezoelectric actuators, can also be used in the alternative.

As discussed above, electrical isolation of the signal path through the switch 10 is achieved by way of the air gaps 50 between the first and second inner conductors 34, 36 and the adjacent internal surfaces of the ground housing 28; and by way of the first and third portions 53*a*, 53*c* of the shuttle 16. The electrical isolation is believed to result in very favorable signal-transmission characteristics for the switch 10. For example, based on finite element method (FEM) simulations, the insertion loss of the switch 10 at 40 GHz is predicted to be approximately 0.09 dB, which is believed to be an improvement of at least approximately 85% over the best in class switches of comparable capabilities. The return loss of the switch 10 at 40 GHz is predicted to be approximately 24 dB, which is believed to be an improvement of at least approximately 85% over the best in class switches of comparable capabilities. The isolation of the switch 10 at 40 GHz is predicted to be approximately 40 dB, which is approximately equal to the isolation achieved by the best in class switches of comparable capabilities.

Moreover, because the switch 10 incorporates a relatively large amount of copper in comparison to other types of MEMS switches, which typically are based on thin-film technologies, the switch 10 is believed to have substantially higher power-handling capability and linearity, with respect to the transmission of both DC and RF signals, than other types of switches of comparable size. Also, the configuration of the switch 10 makes it capable of being monolithically integrated into systems through the routing of micro-coax lines. Moreover, the switch 10 can be fabricated or transferred onto a suite of various exotic substrates.

The switch 10 and alternative embodiments thereof can be manufactured using known processing techniques for creating three-dimensional microstructures, including coaxial transmission lines. For example, the processing methods described in U.S. Pat. Nos. 7,898,356 and 7,012,489, the disclosure of which is incorporated herein by reference, can be adapted and applied to the manufacture of the switch 10 and alternative embodiments thereof.

The switch 10 can be formed in accordance with the following process which is depicted in FIGS. 7A-17B. The first layer of the electrically conductive material forms the ground plane 27; a portion of each leg 86 of the body 80 of the actuator portion 14; and a portion of each lead 82*a*, 82*b* of the actuator portion 14. A first photoresist layer (not shown) is applied to the upper surface of the substrate 26 so that the only exposed portions of the upper surface correspond to the locations at which the ground plane 27, the legs 86, and leads 82*a*, 82*b* are to be located. The first photoresist layer is formed, for example, by depositing photodefinable, or photoresist masking material on the upper surface of the substrate 26 utilizing a mask or other suitable technique.

Figures 7A, 7B:
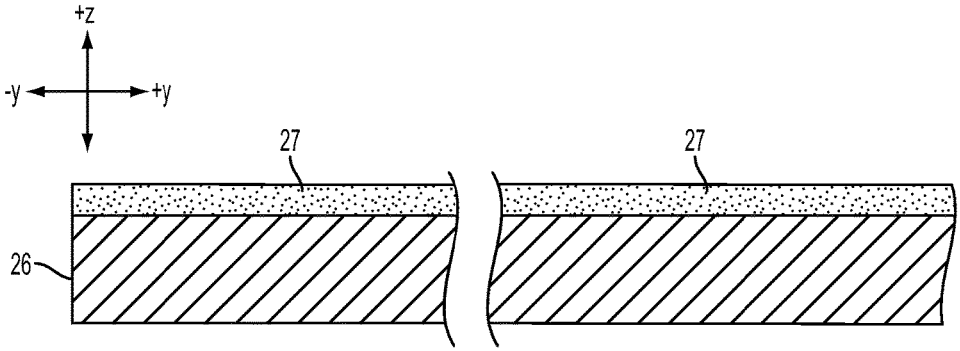
FIGS. 7A, 8A, 9A . . . 17A are cross-sectional views, taken through the line "E-E" of FIG. 1, depicting portions the switch shown in FIGS. 1-6B during various stages of manufacture.
FIGS. 7B, 8B, 9B . . . 17B are cross-sectional views, taken through the line "D-D" of FIG. 1, depicting portions the switch shown in FIGS. 1-6B during various stages of manufacture.

Electrically-conductive material is subsequently deposited on the unmasked, i.e., exposed, portions of the substrate 26 to a predetermined thickness, to form the first layer of the electrically-conductive material as shown in FIGS. 7A and 7B. The deposition of the electrically-conductive material is accomplished using a suitable technique such as chemical vapor deposition (CVD). Other suitable techniques, such as physical vapor deposition (PVD), sputtering, or electroplating, can be used in the alternative. The upper surfaces of the newly-formed first layer can be planarized using a suitable technique such as chemical-mechanical planarization (CMP).

Figure 8A:
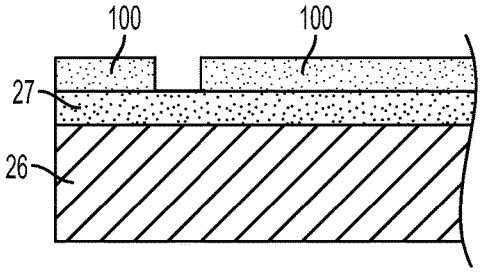
Figure 8B:
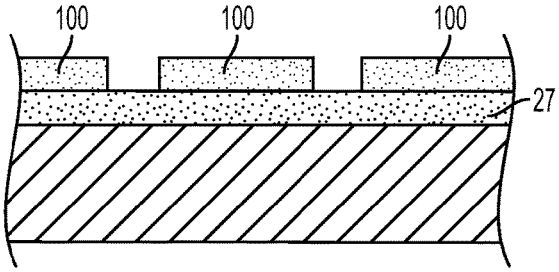
Figure 9A:
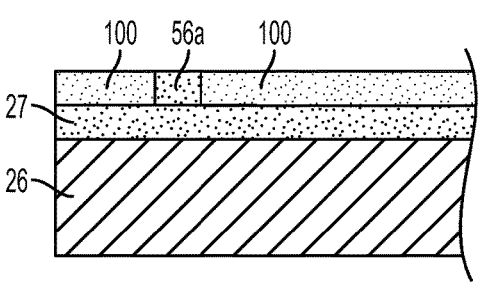
Figure 9B:
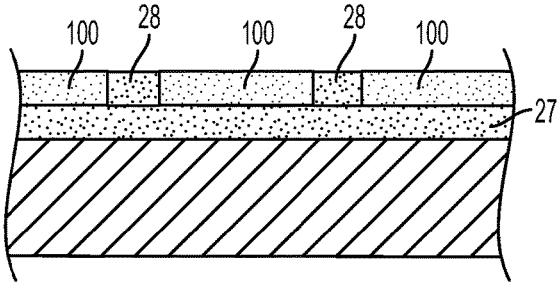

The second layer of the electrically conductive material forms portions of the sides of the ground housing 28; another portion of each leg 86; another portion of the first and second leads 82*a*, 82*b*; and a portion of each of the first and second mounts 56*a*, 56*b*. A second photoresist layer 100 is applied to the partially-constructed switch 10 by patterning additional photoresist material in the desired shape of the second photoresist layer over the partially-constructed switch 10 and over the previously-applied first photoresist layer, utilizing a mask or other suitable technique, so that so that the only exposed areas on the partially-constructed switch 10 and the partially-constructed cover 100 correspond to the locations at which the above-noted portions of the switch 10 are to be located, as shown in FIGS. 8A and 8B. The electrically-conductive material can subsequently be deposited on the exposed portions of the switch 10 to a predetermined thickness, to form the second layer of the electrically-conductive material as shown in FIGS. 9A and 9B. The upper surfaces of the newly-formed portions of the switch 10 can then be planarized.

Figures 10A, 10B:
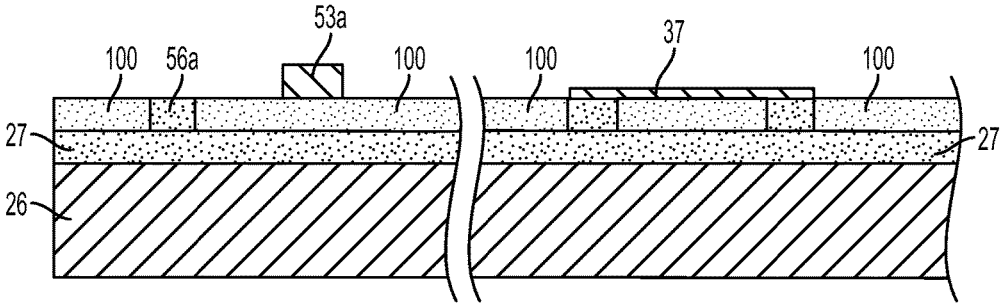

The dielectric material that forms the tabs 37 is deposited and patterned on top of the previously-formed photoresist layer as shown in FIGS. 10A and 10B. The dielectric material that forms the first and third portions 53*a*, 53*c* of the body 52 of the shuttle 16 can be deposited and patterned on top of the previously-formed photoresist layer as also shown in FIGS. 10A and 1B, before or after the tabs 37 are formed.

Figure 11A:
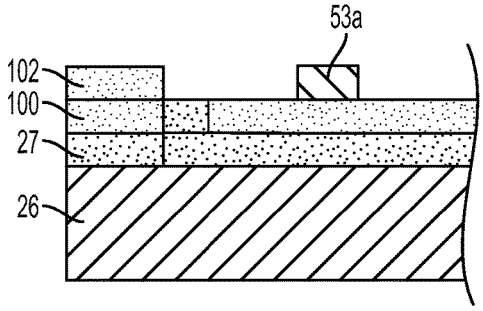
Figure 11B:
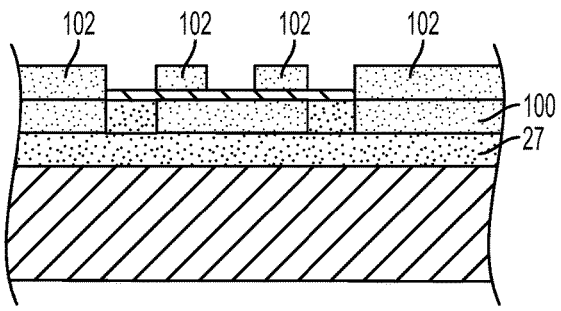
Figure 12A:
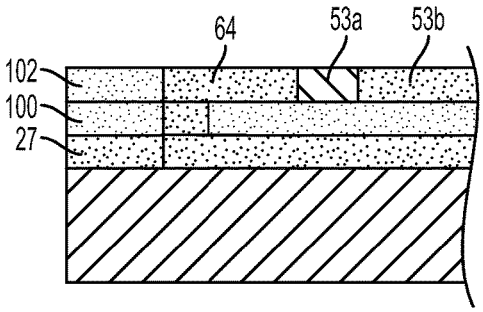
Figure 12B:
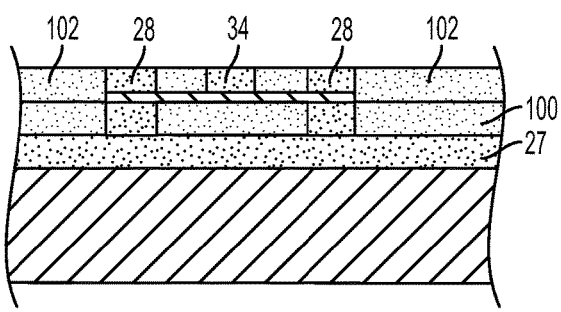
Figures 13A, 13B:
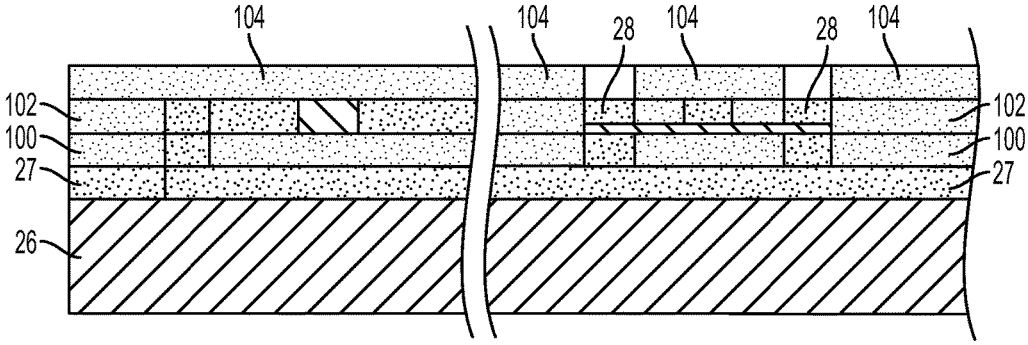
Figures 14A, 14B:
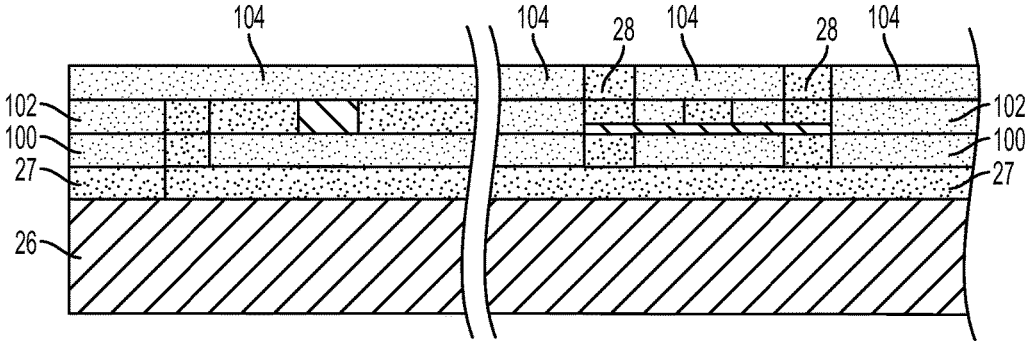
Figure 15A:
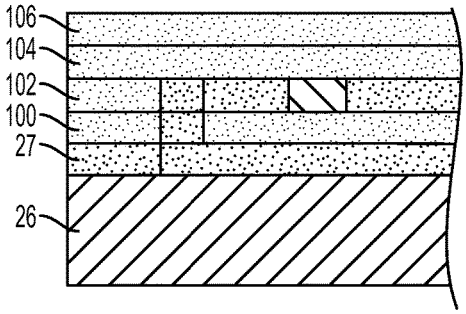
Figure 15B:
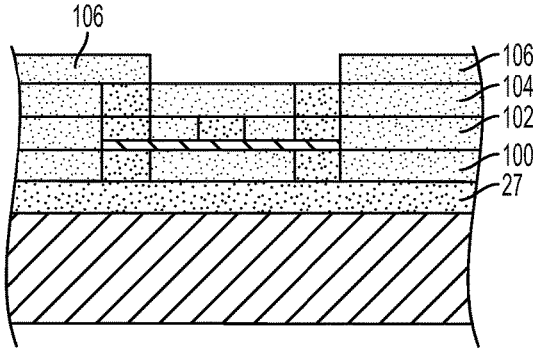
Figure 16A:
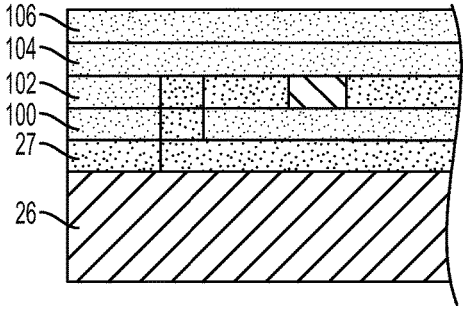
Figure 16B:
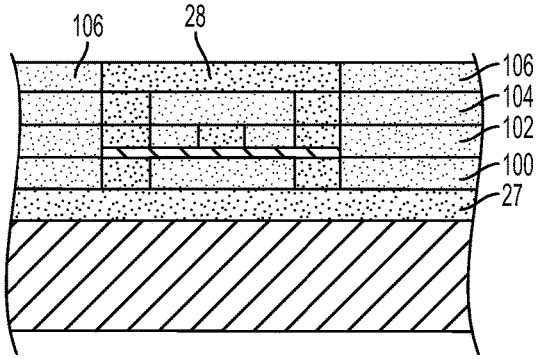

The third layer of the electrically conductive material forms additional portions of the sides of the ground housing 28; the second and fourth portions 53*b*, 53*d* of the body 52 of the shuttle 16; additional portions of each of the first and second mounts 56*a*, 56*b*; and the top portion 88 of the body 80 of the actuator portion 14. A third photoresist layer 102 is applied to the partially-constructed switch 10 by patterning additional photoresist material in the desired shape of the third photoresist layer over the partially-constructed switch 10 and over the second photoresist layer, utilizing a mask or other suitable technique, so that so that the only exposed areas on the partially-constructed switch 10 correspond to the locations at which the above-noted components are to be located, as shown in FIGS. 11A and 11B. The electrically-conductive material can subsequently be deposited on the exposed portions of the switch 10 to a predetermined thickness, to form the third layer of the electrically-conductive material as shown in FIGS. 12A and 12B. The upper surfaces of the newly-formed portions of the switch 10 can then be planarized.

The fourth and fifth layers of the electrically conductive material form, respectively, additional portions of the sides of the ground housing 28, and the top of the ground housing 28. The fourth and fifth layers are formed in a manner similar to the first, second, and third layers. In particular, the fourth and fifth layers are formed by applying additional photoresist material to the previously-formed layers, utilizing a mask or other suitable technique, to form fourth and fifth photoresist layers 104, 106 as shown respectively in FIGS. 13A/13B and 15A/15B, and then depositing additional electrically-conductive material to the exposed areas to form the fourth and fifth layers as shown respectively in FIGS. 14A/14B and 16A/16B. The upper surfaces of the newly-formed portions of the switch 10 can be planarized after the application of each of the fourth and fifth layers.

Figure 17A:
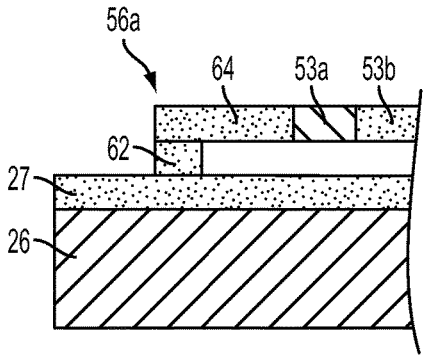
Figure 17B:
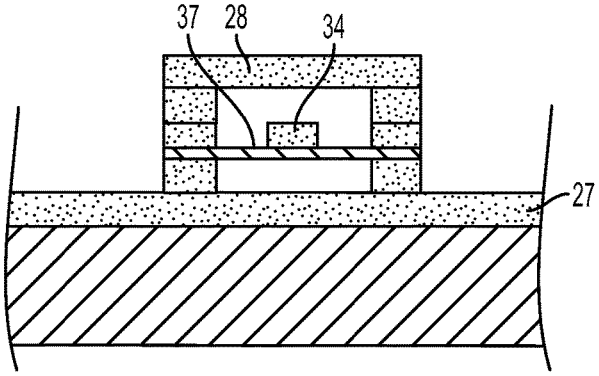

The photoresist material remaining from each of the masking steps can then be released or otherwise removed after the fifth layer has been applied as depicted in FIGS. 17A and 17B, using a suitable technique such as exposure to an appropriate solvent that dissolves the photoresist material.

We claim:

1. A process for making a switch, comprising:

selectively depositing a first layer of an electrically-conductive material on a substrate to form at least a portion of a ground plane and an actuator;

selectively depositing a second layer of the electrically-conductive material on the first layer and the substrate to form at least a portion of each of the actuator, a housing, and a mount for a contact element configured to electrically connect a first and a second electrical conductor on a selective basis when actuated by the actuator; and selectively depositing a third layer of the electrically-conductive material on the first and second layers and the substrate to form at least a portion of each of the housing, the actuator, the mount, the contact element, and the first and second electrical conductors.

2. The process of claim 1, further comprising selectively depositing a fourth and a fifth layer of the electrically-conductive material on the first, second, and third layers and the substrate to form at least a portion of the housing.

3. The process of claim 1, further comprising selectively depositing a dielectric material on the first and second layers and the substrate to form at least a portion of the contact element.

4. The process of claim 1, further comprising selectively depositing a dielectric material on the first and second layers and the substrate to form a support for at least one of the first and second electrical conductor.

5. The process of claim 4, further comprising arranging the dielectric material to coaxially support the first electrical conductor along a first length of the housing to define a first portion of an inner conductor of a micro-coaxial transmission line.

6. The process of claim 5, further comprising arranging the dielectric material to coaxially support the second electrical conductor along a second length of the housing to define a second portion of the inner conductor of the micro-coaxial transmission line.

7. The process of claim 6, further comprising forming an end portion of the second electrical conductor so that it is spaced apart from an end portion of the first electrical conductor to define an air gap along a length of the inner conductor.

8. The process of claim 7, further comprising forming the contact element to include an electrically-insulative first portion, an electrically-conductive second portion and electrically-insulative third portion with the first and third portions adjoining the second portion.

9. The process of claim 8, further comprising forming the housing with an opening defined therein and arranging the contact element so that it can movably extend through the opening.

10. The process of claim 9, further comprising arranging the contact element to facilitate movement between a first position at which the second portion of the contact element is spaced apart and electrically isolated from the first and second electrical conductors, and a second position at which the second portion of the contact element contacts the first and second electrical conductors.

* * * * *